United States Patent [19]

Mamers et al.

[11] 4,163,687

[45] Aug. 7, 1979

[54] METHOD AND APPARATUS FOR EXPLOSIVELY DEFIBRATING CELLULOSIC FIBER

[75] Inventors: Heikki Mamers, Seaford; John E. Rowney, St. Albans, both of Australia

[73] Assignee: Commonwealth Scientific and Industrial Research Organization, Campbell, Australia

[21] Appl. No.: 899,148

[22] Filed: Apr. 24, 1978

[30] Foreign Application Priority Data

Apr. 27, 1977 [AU] Australia ..... PC9894

[51] Int. Cl.[2] ..... D21B 1/36

[52] U.S. Cl. ..... 162/21; 162/22; 162/247; 239/590.5; 241/5

[58] Field of Search ..... 162/21, 52, 246, 247, 162/22; 239/590.5; 138/42; 241/5, 1; 426/621, 625

[56] References Cited

U.S. PATENT DOCUMENTS

| | | | |
|---|---|---|---|
| 2,899,242 | 6/1959 | Teichmann | 162/21 |
| 2,943,012 | 6/1960 | Dunning et al. | 162/21 |
| 3,015,127 | 1/1962 | Stalego | 239/590.5 |
| 3,617,433 | 11/1971 | Sutherland | 162/21 |
| 4,059,231 | 11/1977 | Neu | 241/5 |

OTHER PUBLICATIONS

Goring, "Thermal Softening of Lignin, Hemicellulose and Cellulose", *Pulp and Paper Magazine of Canada*, Dec. 1963.

Mamers et al., "Explosion Pulping of Woodchips", Memorandum No. CE/M34; Commonwealth Scientific and Industrial Research Organisation, Australia, Jun. 1973.

*Primary Examiner*—Richard V. Fisher
*Assistant Examiner*—Steve Alvo
*Attorney, Agent, or Firm*—Sughrue, Rothwell, Mion, Zinn and Macpeak

[57] ABSTRACT

A uniquely designed nozzle is described for assisting the liberation of fibres from cellulosic material during an explosive defibration process. The nozzle is constructed with a plurality of internal bars so as to provide a tortuous path to the material passing therethrough from a region of high pressure to a region of low pressure.

5 Claims, 6 Drawing Figures

METHOD AND APPARATUS FOR EXPLOSIVELY DEFIBRATING CELLULOSIC FIBER

Figure 1:
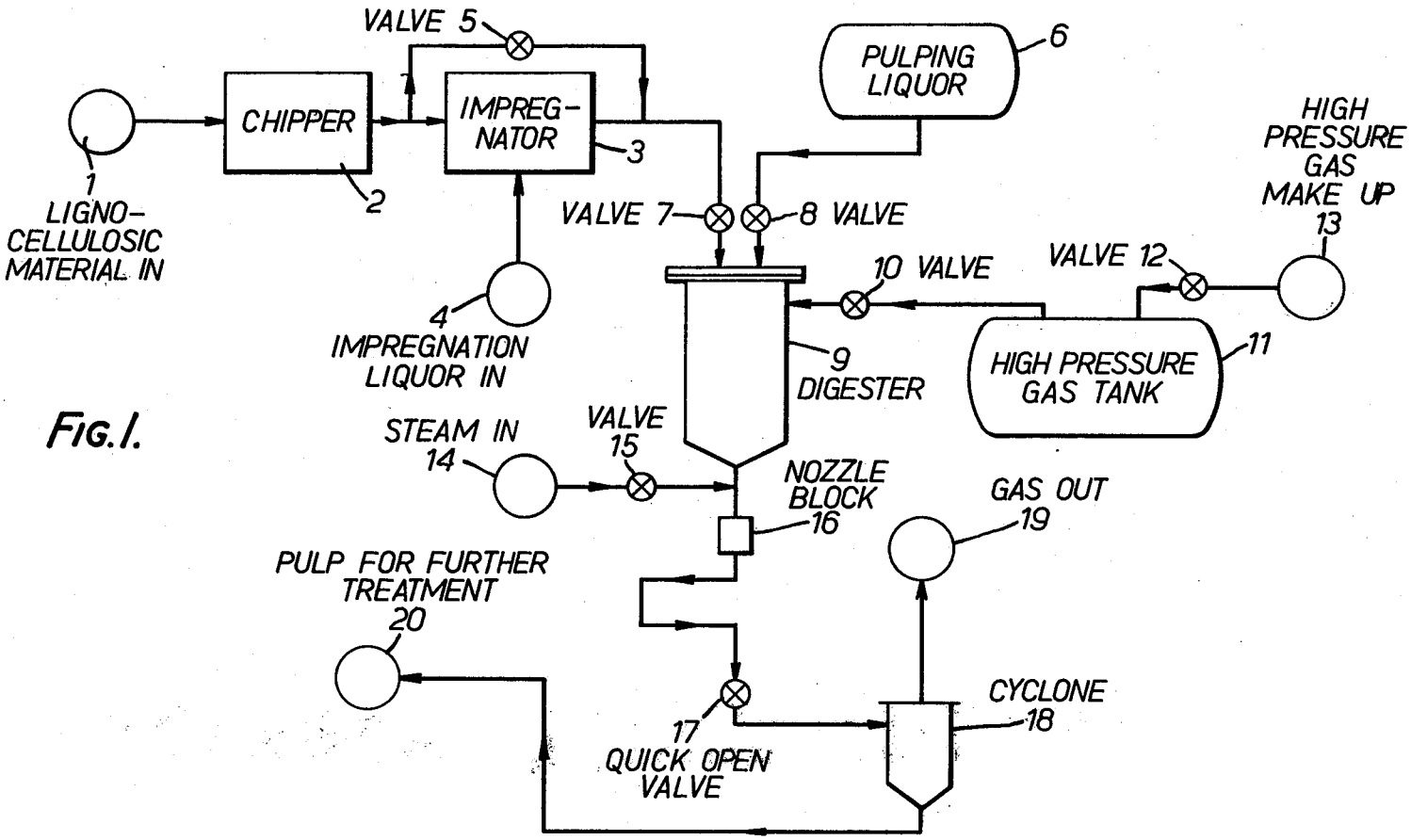

This invention relates to a process for liberating cellulosic fibre from plant material in a form which is suitable for the manufacture of paper and paper-like products. The invention also relates to a novel form of apparatus for use in such a process.

The process is adaptable to the treatment of all manner of plant material ranging from the hardwoods through the fast growing and annual plants to agricultural residues such as straw and bagasse, and is a development of the class of processes generally referred to as "explosion pulping." These processes basically involve rapidly cellulosic material from a high pressure environment to a lower pressure environment whereupon the cellulosic material literally explodes through the agency of the applied physical forces. In general, known explosion pulping processes may be classified into two categories:

(1) where the defibration is produced primarily by the sudden volatilization of a volatile liquid entrapped within the interstices of the cellulosic material; and (2) where the process associated liquids are relatively involatile at the operating conditions but where the force of the explosion is augmented by the injection of a relatively insoluble gas or gas mixture at elevated pressure.

The best known of the volatile liquid explosion processes is the so called "Masonite" process which is described in U.S. Pat. Nos. 1,655,618, 1,824,221, 1,922,313 and 2,140,189, all to W. H. Mason. In the Masonite process, woodchips or similar cellulosic materials are pressurized by steam to pressures as high as 1000 psig (6.9 MPa). Upon sudden discharge of the woodchip/water/steam mixture from the pressurizer, the water trapped within the interstices of the woodchips flashes to steam and provides the necessary energy to produce a well defibrated pulp mass. Such pulp has found extensive use in the fabrications of building boards but is generally regarded as unsuitable for papermaking. The high temperatures associated with the injected steam (saturated 1000 psig steam, for instance, has a temperature of 285° C.) are significantly higher than the softening range of cellulose (determined by Goring to be between 223° C. and 253° C.—see D.A.I. Goring, Pulp and Paper Mag. of Canada, pp T517-T527, Dec. 1963). Thus, when the cellulose is heated to 285° C. and exploded, the softened cellulose fibres are considerably damaged and fragmented by the force of the explosion. The high temperatures of the Masonite process also induce hydrolytic attack of the cellulose, causing further weakening and fibre degradation. The hydrolytic attack can be partially ameliorated by preimpregnating the woodchips with alkalis prior to explosion as has been described in U.S. Pat. No. 1,872,996 to W. H. Mason and U.S. Pat. No. 2,234,188 to H. W. Morgan. However, thermal softening and subsequent explosion damage to the cellulosic fibres as an unavoidable feature of the process; similar temperatures and pressures being required to steam explode alkali treated woodchips as are required to explode untreated woodchips.

Other approaches to paper pulp manufacture by volatile liquid explosion have sought to circumvent the unfavourable temperature/pressure characteristics of the water/steam system by using substantially nonaqueous working fluids. Liquid ammonia (see U.S. Pat. No. 3,707,436 to J. J. O'Connor) and liquid sulphur dioxide (see H. Mamers, N.C. Grave; C.S.I.R.O. Division of Chemical Engineering Memorandum No. CE/M34, June 1973) have both been found to give effective defibration and yield paper making quality pulps when used as exploding agents. However the intrinsic technical problems associated with recycling large volumes of liquified gas have precluded the processes from general application.

In the second category of explosion methods, the gas aided processes, the disadvantageous thermodynamic properties of the steam/water system are avoided by arranging that temperature and pressure are independent process variables. The processes are generally operated at temperatures where steam pressure alone would be insufficient to defibrate the chips upon explosion, but high pressure gas is admitted to the digester prior to explosion and this high pressure gas provides the energy necessary for fibre liberation. Disclosed gas aided explosion processes have included the defibration of steamed woodchips expelled from digesters further pressurized by permanent gases (see U.S. Pat. Nos. 1,578,609 and 1,586,159 both to W. H. Mason) and the defibration of chemically pretreated woodchips in which the system was further pressurized by gaseous carbon dioxide, ammonia or sulphur dioxide (see U.S. Pat. No. 2,977,275 to L. T. Work).

Taken overall, the prior art gas assisted explosion processes have not been as efficient in defibrating woodchips and other cellulosic materials as the volatile liquid explosion methods. The slits (U.S. Pat. No. 1,824,221) and circular holes (U.S. Pat. No. 3,707,436) used as digester discharge nozzles in the volatile liquid explosion methods have proved ineffective in adequately converting the potential energy of the pressurizing gas into useful work done upon the chips. Alternative discharge nozzle designs which have been proposed have included venturi chokes (see U.S. Pat. No. 3,617,433 to D. G. Sutherland) and impinging jets (U.S. Pat. No. 2,977,275) but none of these has found wide acceptance. In general, it has been the absence of an efficient means of converting gas potential energy into work of defibration which has inhibited the further development of gas assisted explosion defibration into a viable alternative process for the production of papermaking quality pulp.

The present invention offers an improved method of producing papermaking quality pulp by using the general techniques of gas aided explosion defibration but discharging the processed cellulosic material through nozzles of novel design, which give highly efficient conversion of the potential energy of the pressurizing gas into work of defibration upon the cellulosic material whilst inflicting minimal damage to the desired cellulosic fibres.

Accordingly, in a process for liberating cellulosic fibre from plant material wherein the plant material is subjected to a high pressure environment followed by rapid transfer to a lower pressure environment, the improvement comprising passing the material from the high to the lower pressure environment by way of a discharge nozzle in which a plurality of obstructions are arranged in such a manner as to provide a tortuous path to the discharging material.

In a further aspect of the invention, there is provided a discharge nozzle through which cellulosic material is passed from a high pressure-pulping digester to a lower pressure reservoir, said nozzle characterized by a plurality of bars extending across its passageway at varying locations along its longitudinal axis so as to provide a tortuous path to the passing material.

The mode of operation of the discharge nozzle is such that upon passage of the processed cellulosic material through it, the material is folded over the bars. The concomitant discharge of the high pressure gas and process liquids then exerts tensile forces upon the folded cellulosic material, causing the material to be pulled apart. This process is repeated over successive bars within the nozzle, producing a progressively finer degree of defibration until, upon final discharge, the cellulosic material has been substantially reduced to individual fibres and small fibre bundles.

By subjecting the processed material to successive tensile forces the cellulosic material predominantly cleaves along the planes of least strength, that is along the softened lignin layers binding the cellulosic fibres together and very little, if any, fibre damage results from the action of the nozzle.

Preferred design aspects of the discharge nozzle are summarized in the following paragraphs:

(1) The bars within the nozzle should ideally not present any sharp edges facing the direction of flow of the cellulosic material since otherwise there will be a tendency for the fibres to be cut. Particularly preferred bars which meet this ideal are those having a cross-section which is circular, oval, rectangular with a curved leading edge, triangular with a curved leading edge. However, it will be appreciated that practically any geometrical cross-sectional shape may be suitable provided that there are no sharp edges facing the flow.

(2) The diameter or minimum thickness of the bars should ideally be greater than 2 mm and no more than 13 mm since below 2 mm the bars themselves act as knives and excessive damage results to the fibres while above 13 mm thickness, the radius over which the discharging chips are folded becomes too large for efficient defibration.

(3) The spacing of the bars along the length of the nozzle will be determined by the physical dimensions of the material being treated. For woodchips with an average length "x" for instance, the spacing between the successive bars should ideally be no less than x/2 and preferably greater. Placing the bars too close together will lead to mutual interference during the folding processes which the material undergoes during passage through the nozzle.

(4) The minimum number of bars and their arrangement in the nozzle should preferably be such that when the nozzle is viewed in plan, no clear vertical passage exists through which a fragment of the ligno-cellulosic material may pass without striking a bar.

For the case of a circular orifice spanned by diametrically located bars as shon in FIG. 1, the minimum number of bars required to give complete plan-viewed coverage of the orifice may be calculated from the formula:

$$N_B = \frac{180}{2 \sin^{-1} \left(\frac{t}{2r}\right)}$$

where $N_B$=minimum number of bars t=thickness or diameter of the bars when viewed along the axis of the nozzle.

r=radius of the nozzle orifice.

If the above formula gives $N_B$ as a fractional value, then the number $N_B$ should be rounded upwards to the nearest whole number. For example, if the calculated value of $N_B$ is to say 8.2, then the minimum number of bars of equal thickness required to give complete coverage of the nozzle becomes 9.

For designs where a number of bars span the nozzle orifice in the same plane or when the nozzle orifice is non-circular, a rapid method for calculating the number of bars or layers of bars required for substantially complete coverage of the orifice is given by the relationship.

$$N_L = (A_c/A_b) + 1$$

where $N_L$=number of bars or layers of bars $A_c$=area of the nozzle orifice $A_b$=projected area of the bar or layers of bars viewed in the axial direction of the nozzle.

Again, when $N_L$ assumes a fractional value, the value should be rounded upwards to the next whole number.

The values $N_B$ or $N_L$ represent the minimum number of bars or layers of bars required for complete coverage of the nozzle orifice. Nozzles may be constructed with less than this number of bars, but the nozzle efficiency will be reduced because a proportion of the ligno-cellulosic material will pass through the nozzle without contacting a bar and will be inadequately defibrated.

The number of bars may be greater than $N_B$ or $N_L$ if required, $N_B$ or $N_L$ representing the minimum number of bars rather than the maximum. With a greater number of bars, more complete defibration is obtained although a correspondingly higher minimum applied gas pressure will be required to force the ligno-cellulosic material through the nozzle without blockage.

Figure 3:
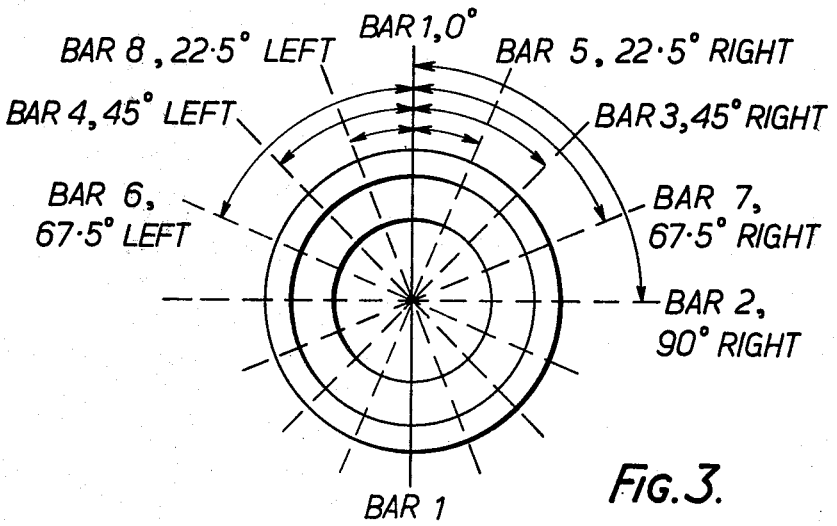

The applied pressure required to satisfactorily operate the nozzles without blockage will be dependent upon the nature of the original ligno-cellulosic material and the extent of lignin removal and softening experienced during the cooking process. However, for high yield pulping of woodchips in a digester system where the volume of the high pressure gas reservoir is equal to the volume of the digester, an approximate requirement is one MPa of gas pressure per bar or layer of bars. Hence, an 8 bar nozzle such as shown in FIG. 3 (see following description) would require a minimum pressure of 8 MPa for the defibration of high yield woodchips. Operating the digester above 8 MPa will give a proportional increase in defibration. This is illustrated in Example 3 below.

(5) The orientation of the bars (or layers of bars) in the nozzle should be such as to present a maze to the ligno-cellulosic material passing through the nozzle. The angles at which the axes of the bars are set to the long axis of the nozzle should preferably be randomised as far as possible. If the successive bars are set at a regular angular displacement from one bar to the next, then a spiral is established. This regular spiral arrangement should be avoided as the outer sweep of the spiral represents a path through which some portion of the ligno-cellulosic material can travel without striking a bar and thus escaping adequate defibration.

In randomising the bar angles, the angles between successive bars in the nozzle should be made as large as possible and the situation avoided where one bar substantially covers the next bar in the nozzle.

Figure 2:
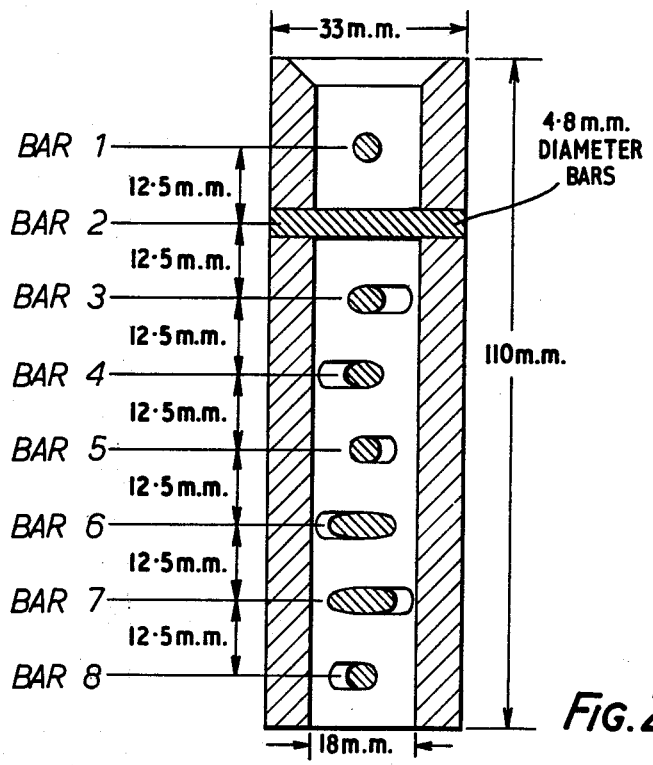
Figure 4:
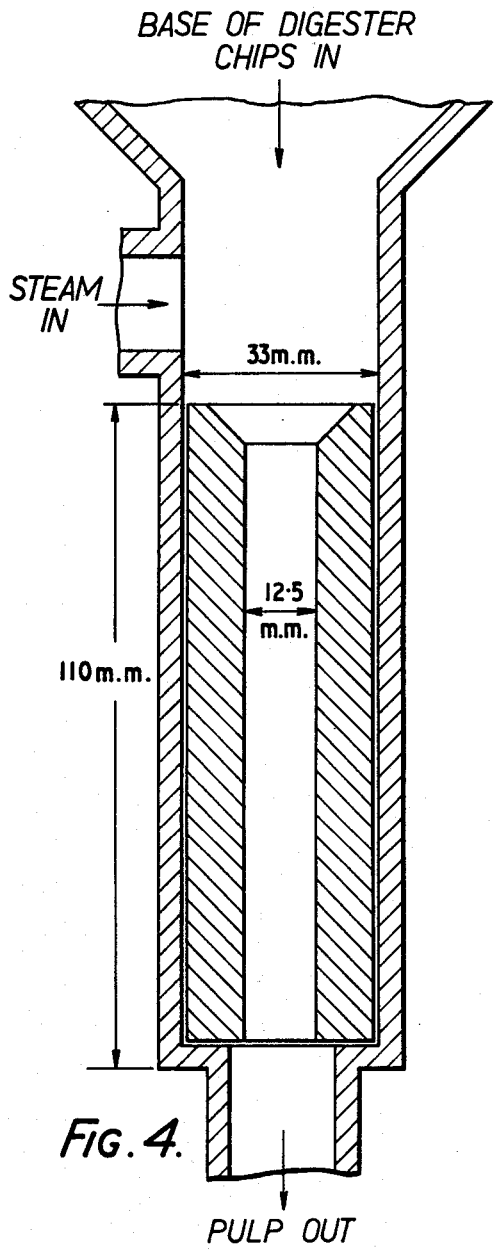
Figure 5:
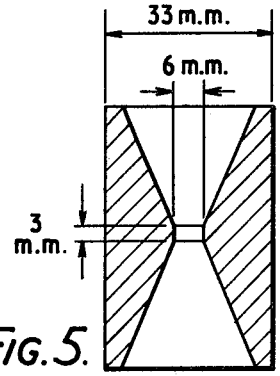
Figure 6:
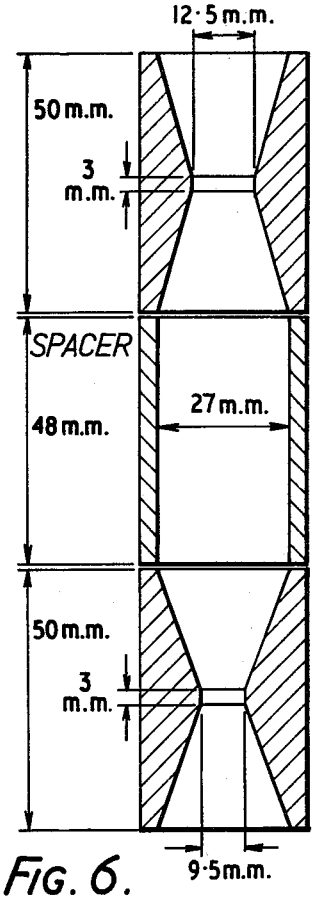

The invention will now be described with reference to the accompanying drawings, in which:

FIG. 1 is a schematic representation of a system for separating cellulosic material incorporating the discharge nozzle of the present invention, FIG. 2 is a cross-sectional view of a discharge nozzle according to the invention, FIG. 3 is a schematic plan view of the nozzle illustrated in FIG. 1 showing the relative arrangement of the bars within the nozzle, FIG. 4 is a cross-sectional view of a circular choke nozzle of the type disclosed in U.S. Pat. No. 3,707,436, FIG. 5 is a cross-sectional view of a single venturi nozzle of the type disclosed in U.S. Pat. No. 2,889,242, and FIG. 6 is a cross-sectional view of a double venturi nozzle which is a refinement of the nozzle illustrated in FIG. 5.

Referring to FIG. 1, the cellulosic material to be pulped enters the system at (1). Chipper (2) reduces the material in size to dimensions generally regarded as suitable for chemical pulping. For woody furnishes, this would comprise subdividing the material to chips some 20 mm to 50 mm long, 10 mm to 30 mm wide and 3 mm to 8 mm thick. For annual and rapid growing plant material such as kenaf, bagasse and cereal straw, the chipper would reduce the material to a size convenient for subsequent handling.

From the chipper (2), the subdivided ligno-cellulosic material passes into the impregnator (3). In the impregnator (3) pulping chemicals are forced into the body of the ligno-cellulosic material by known means. These may include, for example, pre-steaming the ligno-cellulosic material and then immersing the steamed material in cold pulping liquor. Or, alternatively, the ligno-cellulosic material may be immersed in the pulping liquor and subjected to successive pressure and vacuum cycles.

The nature and concentration of the pulping chemicals in the impregnator liquor will be determined by the subsequent properties desired in the paper-pulp produced by the process. The liquor may be acidic, alkaline or substantially neutral. Acidic liquors such as those containing dissolved sulphur dioxide for instance, will produce acid-sulphite type pulps. Alkaline liquors such as sodium hydroxide solutions, will produce soda type pulps and so on. The concentration of pulping chemicals in the liquors and the quantity of chemicals impregnated into the ligno-cellulosic material will be governed by the intended yield of pulp product per unit of ligno-cellulosic material charged to the process. For high yield pulps, that is pulps with a yield of 80% or greater, the quantity of chemicals impregnated into the ligno-cellulosic material may be 10% or less (on a dry solids basis). For lower yield pulps, where more of the lignin bonding material is to be removed by chemical action, a correspondingly higher quantity of pulping chemicals would be impregnated into the ligno cellulosic furnish.

After the impregnator (3), the ligno-cellulosic material is disengaged from the impregnating liquor and charged to the digester (9).

In another embodiment, the impregnator (3) may be by-passed and the ligno-cellulosic material fed directly from the chipper (2) to the digester (9) together with the appropriate quantity of pulping liquor from the pulping liquor storage tank (6).

In FIG. 1, the digester (9) is indicated as a batch digester although the general principles and method of the invention may also be applied to continuously operating digesters In batchwise operation, the digester (9) will generally, although not necessarily, be of circular cross section with a conical base. Below the conical base is a point for steam injection and, below this, is mounted the defibrating nozzle (16). Below the nozzle (16) is a quick opening valve (17). The valve (17) may be a ball valve or a plug valve or any other full flow design which can be fully opened from a fully closed position in a time preferably not exceeding one second. At the top of the digester, valve (10) connects the body of the digester to the high pressure gas tank (11).

The digester (9) and associated equipment are constructed of materials which are compatible with the pressure, temperature and chemical conditions pertaining to the pulping operations.

In batchwise operation, after charging the digester (9) with the ligno-cellulosic material (and pulping liquor if required), the digester is sealed and heating commenced.

The preferred method of heating is by the direct injection of steam from (14) via valve (15) into the base of the digester (9). The maximum digester temperature attained by steam injection should not exceed 220° C., corresponding to a saturated steam pressure of 2.2 MPa. At temperatures above 220° C., cellulose softening may occur as in the Masonite process, with subsequent fibre damage upon explosion. The rate of steam injection should be as rapid as possible, a heatup time of a few minutes being preferable to a more protracted approach to the operating temperature.

After attaining the required digester temperature, the steam injection is discontinued by closing valve (15) and the digester further pressurized by admitting high pressure gas from tank (11) by opening valve (10). Unless a specific reaction is sought, a requirement of the high pressure gas is that the gas be relatively inert towards the pulping chemicals added together with the ligno-cellulosic material. The preferred gas is nitrogen, although in many instances cleaned flue gas may be satisfactorily used. Other potentially suitable gases are carbon dioxide and air. When using air, however, care has to be taken that the partial pressure of the oxygen remains below a level where uncontrolled oxidation and explosion could occur within the digester system.

The time for which the digester contents are maintained under gas pressure will be determined by the digester operating temperature and desired product yield. For high yield pulps prepared at relatively high temperatures (say 200° C. or higher), the processing times will be a few minutes only. For lower yield pulps prepared at lower cook temperatures, the cook periods will be more protracted but in all instances it is unlikely that the cook period will exceed one hour.

With the shorter cook periods, no further heating other than the original steam injection will be required, provided that the digester system is adequately insulated. For more protracted cooks, some form of external heating for the digester will be required to maintain the processing temperature. Externally applied electrical resistance heating at an intensity of approximately 1 kW per $m^2$ of digester surface has been found adequate for this purpose, provided that the digester is well insulated.

The required gas pressure and the volume of the gas reservoir tank (11) relative to the digester (9) will be determined by the characteristics of the ligno-cellulosic material being processed.

The volume and pressure of the gas in the reservoir tank (11) represents the amount of potential work available in the system for defibrating the processed ligno-cellulosic material upon discharge at the end of the cooking period. Woodchips cooked to a high yield, for instance, will require more energy for defibration than woodchips cooked to a lower yield. Hence, with a fixed reservoir tank and digester geometry, a higher pressure will be needed to adequately defibrate high yield pulps than is needed to defibrate lower yield pulps. However, even with the highest yield pulps from the most difficult to defibrate materials, the maximum operating pressure would be unlikely to exceed 25 MPa and in most instances would be considerably less.

Digester discharge at the end of the cooking period is initiated by rapidly opening valve (17). The gas pressure in the digester forces the treated ligno-cellulosic material through the nozzle (16) and the pulp so produced is discharged into the cyclones (18). The cyclone (18) separates the gas and steam from the pulp and spent liquor. The pulp product proceeds for further treatment (2), whilst the expelled gas (19) is either released to atmosphere or recycled for recompression and return to tank (11).

The line connecting the digester (9) and the high pressure gas tank (11) should be of such a diameter as to permit a free flow of gas between the two vessels during the discharge period. Valve (10) may be kept open during the entire discharge or may be closed once the digester contents have been expelled. The latter operating method is more economical of gas usage than the former method.

Apart from the general variables of temperatures, time, gas pressure, relative gas volume and chemical addition, the most critical factor in determining the degree of defibration obtained under given process conditions is the design of the digester nozzle block.

Referring now to FIG. 2 which illustrates a preferred nozzle according to the invention, the nozzle comprises a tube of uniform cross-sectional diameter with an 18 mm internal bore. Within this tube are set eight cylindrical bars of 4.8 mm diameter, the bars spanning diametrically across the tube. Each bar is displaced from its neighbouring bar by 12.5 mm. In plan view, see FIG. 3, each bar is angularly displaced from the bars immediately preceding and following it to present a path of maximum tortuosity to the discharging cellulosic material.

In describing the angular arrangement of the bars, the following system has been adopted.

When viewed in plan (FIG. 3) the orientation of the axis of the first bar in the nozzle is taken as 0° and this bar is called Bar 1. The axis of the next bar (Bar 2) is then described as being displaced a number of degrees either right or left from the original 0° orientation. Thus, when the next bar (Bar 2) is at say 90° to Bar 1, the orientation of Bar 2 is described as "90° Right" and so on.

Applying this system to the nozzle shown in FIGS. 2 and 3, the description then becomes:

| Bar No. | Angular displacement of bar axis |
|---|---|
| 1 | 0° |
| 2 | 90° Right |
| 3 | 45° Right |
| 4 | 45° Left |
| 5 | 22.5° Right |
| 6 | 67.5° Left |
| 7 | 67.5° Right |
| 8 | 22.5° Left |

Turning to FIG. 4, there is illustrated one of the simplest and least effective prior art discharge nozzles, viz a uniform cross-section circular choke. This choke relies for its defibrating action upon compressing the incoming cellulosic material and then releasing the compressive forces as the material is ejected from the choke.

A slightly more efficient design is the venturi type of nozzle described by Teichmann (U.S. Pat. No. 2,889,242). In its simplest form, the nozzle comprises of a single venturi, as shown in FIG. 5. In a more complex type, a double venturi system may be used (FIG. 6). Again, these venturi nozzles rely upon chip compression as the main mechanism of defibration.

The venturi nozzles fit into the base of the digester in the same manner as the circular choke nozzle indicated in FIG. 4.

The action of the discharge nozzle according to the present invention differs from these prior art nozzles in that as well as producing some initial compression of the material entering the nozzle, the bars of the nozzle subject the cellulosic material to successive tensile forces during its passage through the nozzle.

The following example demonstrates the improved defibration obtained by use of the present nozzle when compared with previously disclosed designs.

EXAMPLE 1

This example refers to the pulping of *Pinus elliottii* woodchips. 880 g of woodchips (oven dried basis) were charged into a digester together with 4 liters of liquor containing 50 g/l sodium sulphite solution. The chips and liquor were heated to 200° C. by direct steam injection, and the digester was further pressurized to 10.3 MPa with nitrogen gas. The digester contents were maintained under pressure at 200° C. for 10 mins before discharge. This procedure was repeated four times, each time the cooked chips being discharged through a nozzle of different design.

In Table 1 (below), cook A corresponds to the chips discharge through the nozzle depicted in FIG. 4. In cook B, the chips were discharged through the single stage venturi nozzle shown in FIG. 5 and in cook C the chips were discharged through the double venturi nozzle arrangement shown in FIG. 6. Cook D corresponds to the chips discharged through the eight bar nozzle of the present invention shown in FIG. 2.

TABLE 1

Effect of nozzle design on defibration of *Pinus elliottii* woodchips

| Cook No. | Nozzle type | Defibration (%) |
|---|---|---|
| A | Circular choke | 14.7 |
| B | Single stage venturi | 16.2 |
| C | Double stage venturi | 22.2 |
| D | Eight bar nozzle | 63.8 |

The defibration value given in Table 1 corresponds to the percentage weight of pulp discharged from the digester passing through an 0.25 mm slotted screen.

The results given in Table 1 clearly demonstrate the defibration efficiency advantages to be gained when using a bar nozzle of the present invention as opposed to the previously disclosed circular chokes and venturi nozzles.

The following examples illustrate various other aspects of the invention:

EXAMPLE 2

This example illustrates the effect of the number of nozzle bars upon the defibration obtained with *Pinus radiata* woodchips.

850 g (oven dry basis) of woodchips were charged into the digester with 4 liters of 50 g/l sodium sulphite solution, the digester contents heated to 200° C. by direct steam injection, the digester further pressurized to 13.8 MPa with nitrogen and the woodchips maintained under pressure at 200° C. for 10 minutes before discharge.

Successive cooks were discharged through a 2 bar, an 8 bar and a 12 bar nozzle respectively. The nozzle bars in all instances were 4.8 mm diameter and the orifice diameter 18 mm. The bar spacing was 85 mm for the 2 bar nozzle and 12.5 mm for the 8 bar and 12 bar nozzles.

Using the previously indicated notation, the three nozzles had the bars arranged as follows:

| Bar No. | 2 bar nozzle | 8 bar nozzle | 12 bar nozzle |
|---|---|---|---|
| 1 | 0° | 0° | 0° |
| 2 | 90° Right | 90° Right | 90° Right |
| 3 | | 45° Right | 45° Right |
| 4 | | 45° Left | 45° Left |
| 5 | | 22.5° Right | 22.5° Right |
| 6 | | 67.5° Left | 67.5° Left |
| 7 | | 67.5° Right | 22.5° Left |
| 8 | | 22.5° Left | 67.5° Right |
| 9 | | | 0° |
| 10 | | | 90° Right |
| 11 | | | 45° Right |
| 12 | | | 45° Left |

The defibration obtained with the nozzles is given in Table 2 below:

TABLE 2

Effect of number of bars on the defibration of *Pinus radiata* woodchips

| Cook | Nozzle type | Defibration (%) |
|---|---|---|
| E | 2 bar | 57.8 |
| F | 8 bar | 70.1 |
| G | 12 bar | 82.1 |

The eight bar nozzle represented the minimum number of bars of 4.8 mm diameter required to give complete axial coverage of the 18 mm diameter choke nozzle. A better result was obtained with the 8 bar nozzle than with the 2 bar nozzle, the latter only giving a coverage of some 25% of the nozzle cross-sectional area. A further improvement in defibration was obtained with the 12 bar nozzle as opposed to the 8 bar, the 12 bars ensuring that a proportion of the ligno-cellulosic material struck at least two bars within the nozzle before discharge.

EXAMPLE 3

With a given nozzle and digester arrangement and fixed cooking conditions in terms of wood species, cooking chemical, cooking time and temperature, the extent of defibration obtained upon discharge is directly proportional to the applied digester pressure; the higher pressure giving the better defibration.

Cook H (Table 3, below) was a *Pinus radiata* woodchip cook discharged through the eight bar nozzle described in Example 2. The cooking procedure for cook H was the same as previously described in Example 2, except that the digester was pressurized with nitrogen to 10.3 MPa rather than 13.8 MPa as in the corresponding cook F.

TABLE 3

Influence of digester pressure upon the defibration of *Pinus radiata* woodchips

| Cook | Digester pressure (MPa) | Defibration (%) |
|---|---|---|
| F | 13.8 | 70.1 |
| H | 10.3 | 53.9 |

Thus, as can be seen from Table 3, elevating the digester pressure from 10.3 MPa to 13.8 MPa improved the defibration of the woodchips from 53.9% to 70.1%.

EXAMPLE 4

As well as the number of bars, the bar arrangement assumes an important role in determining the efficiency of the nozzle. A nozzle of 8 bars, 4.8 mm bar diameter, 18 mm nozzle diameter, 12.5 mm bar separation was constructed in which each bar was rotated by 22.5° with respect to the bar immediately above to form a regular spiral. Apart from the bar arrangement, this nozzle corresponded exactly with the 8 bar nozzle described in Examples 1 and 2.

In a comparison test, *Pinus elliottii* woodchips were cooked according to the conditions described in Example 1 and discharged through the spirally arranged 8 bar nozzle to produce pulp J. The defibrations obtained under these conditions with the spirally arranged 8 bar nozzle and the randomly arranged 8 bar nozzle are listed in Table 4 below.

TABLE 4

Effect of bar arrangement on the defibration of *Pinus elliottii* woodchips

| Cook No. | Nozzle | Defibration (%) |
|---|---|---|
| D | 8 bar nozzle with randomly arranged bars | 63.8 |
| J | 8 bar nozzle with spirally arranged bars | 34.1 |

The importance of having the nozzle bars in a non-regular configuration can be seen from the improved defibration obtained with the randomly arranged bars in cook D when compared with spirally arranged bars in cook J.

EXAMPLE 5

This example further illustrates the results of applying the method of the present invention to the cooking and defibration of mountain ash eucalypt woodchips.

The cooks were all pressurized to 13.8 MPa with nitrogen and discharged through the 12 bar nozzle described in Example 2. Otherwise, the operating conditions were as detailed in Table 5(a) below.

TABLE 5(a)

Cooking and defibration of mountain ash eucalypt woodchips

| Cook | Wt. O.D. wood charged to digester (g) | Volume of liquor charged (l) | Liquor Composition | Cook Temp (°C.) | Time at cook (mins) | Pulp Yield (%) | Defibration (%) |
|---|---|---|---|---|---|---|---|
| K | 905 | 4 | 40.5g/l $Na_2SO_3$<br>9.5g/l $Na_2CO_3$ | 190 | 30 | 68.1 | 93.3 |
| L | 910 | 2.5 | 44.1g/l $Na_2SO_3$<br>10.9g/l $Na_2CO_3$ | 197 | 10 | 72.5 | 86.7 |
| M | 910 | 4 | 27.6g/l $Na_2SO_3$<br>6.4g/l $Na_2CO_3$ | 185 | 20 | 70.8 | 78.8 |
| N | 910 | 4 | 20.3g/l $Na_2SO_3$<br>4.7g/l $Na_2CO_3$ | 185 | 30 | 74.2 | 82.8 |
| O | 910 | 4 | 34g/l $Na_2SO_3$ | 185 | 30 | 74.1 | 79.1 |

After further refining, the properties of the pulps produced from the cooks K to O were as given in Table 5(b). In Table 5(b) the pulp number corresponds to the cook number listed in Table 5(a).

TABLE 5(b)

Properties of mountain ash eucalypt pulps

| Pulp | Freeness (C.s.f.) | Tear Index | Breaking length (km) | Burst Index | Concora Crush N |
|---|---|---|---|---|---|
| K | 300 | 8.4 | 7.0 | 4.6 | 415 |
| | 200 | 8.3 | 7.8 | 5.3 | 430 |
| L | 300 | 7.8 | 6.2 | 3.4 | 375 |
| | 200 | 7.8 | 6.6 | 3.7 | 390 |
| M | 300 | 7.3 | 5.7 | 2.4 | 330 |
| | 200 | 7.4 | 6.0 | 2.5 | 360 |
| N | 300 | 8.1 | 6.3 | 3.6 | 350 |
| | 200 | 7.8 | 6.6 | 3.9 | 365 |
| O | 300 | 8.0 | 6.4 | 3.8 | 370 |
| | 200 | 7.7 | 7.1 | 4.1 | 380 |

EXAMPLE 6

This example relates to the results obtained when mountain ash eucalypt woodchips were pre-impregnated with chemicals prior to charging to the digester, the impregnated woodchips separated from the impregnating liquor and the woodchips then loaded into the digester without the further addition of chemicals.

The cooks here exemplified were all for 3 min duration at the designated cooking temperature. The rate of steam injection into the digester was such that the designated cooking temperature was reached after a heating period of 5 mins. After attaining the cooking temperature, the digester was further pressurized to 13.8 MPa with nitrogen. At the end of the cooking period, the cooked chips were discharged through the 8 bar nozzle described in Examples 1 and 2.

TABLE 6(a)

Cooking and defibration of impregnated mountain ash eucalypt chips

| Cook No. | Wt Chemicals impregnated into woodchips (based on O.D. wood) | Cook temp (°C.) | Pulp yield (%) | Defibration (%) |
|---|---|---|---|---|
| P | 10.0% $Na_2SO_3$ | 200 | 80.5 | 74.9 |
| Q | 5.6% NaOH + 4.4% $Na_2SO_3$ | 200 | 69.9 | 83.5 |
| R | 5.7% $Na_2SO_3$ + 1.3% $Na_2CO_3$ | 205 | 78.0 | 75.1 |

After refining, the properties of the pulps produced in cooks P, Q and R were as given in Table 6(b). The pulp numbers in Table 6(b) correspond to the cook numbers in Table 6(a).

TABLE 6(b)

Properties of pulps produced from chemically impregnated mountain ash eucalypt woodchips

| Pulp No. | Freeness (C.s.f.) | Tear Index | Breaking length (km) | Burst Index |
|---|---|---|---|---|
| P | 457 | 5.6 | 4.8 | 2.1 |
| Q | 228 | 8.5 | 6.4 | 3.8 |
| R | 352 | 7.4 | 6.7 | 3.7 |

EXAMPLE 7

The method of the present invention is especially advantageous in the defibration of rapid growing and annual plants.

These materials differ from woodchips in having a higher parenchyma cell or pith content than woodchips. These parenchyma cells are thinner walled and generally shorter in length than the desired cellulosic fibre components of the plants. Upon conventional pulping, the parenchyma cells readily collapse and remain associated with the pulp to give a final product or poor drainage characteristics.

When fast growing or annual plants are defibrated through the nozzles of the present invention, the bars of the nozzle serve to disrupt the parenchyma cells into small fragments whilst leaving the cellulosic fibres undamaged. Consequently, the pulp produced by the present invention from fast growing and annual plants is a mixture of parenchyma cell fragments and intact fibres. Upon washing and screening this pulp by known methods, the parenchyma cell fragments can be readily removed to give a free draining pulp primarily composed of the structural cellulosic fibres of the plants.

Table 7(a) summarizes the results of processing the outer bark fraction of kenaf (cook S) and undepithed bagasse (cook T) by the method of the invention. The cooks were further pressurized with nitrogen.

TABLE 7(a)

| Treatment of kenaf bark and undepithed bagasse | | | | | | | |
|---|---|---|---|---|---|---|---|
| Cook No. | Wt O.D. material charged to digester (g) | Liquor charged to digester | Cooking conditions | Nozzle Type | Digester pressure (MPa) | Pulp Yield (%) | Defibration (%) |
| S | 352g of kenaf bark | 4l of 50g/l $Na_2SO_3$ | 5 mins at 185° C. | 12 bar | 13.8 | 55 | 94.6 |
| T | 450g of undepithed bagasse | 4l of 50g/l $Na_2SO_3$ | 10 mins at 201° C. | 8 bar | 10.3 | 44.1 | 99 |

The yields in Table 7(a) refer to the yield obtained after the pulp had been washed and screened over a 150 mesh screen to remove the fragmented parenchyma cells.

The properties of the washed and screened pulp obtained from undepithed bagasse (Pulp T) are given in Table 7(b).

TABLE 7(b)

| Properties of pulp obtained from undepithed bagasse | | | | | | |
|---|---|---|---|---|---|---|
| Pulp No. | Beating (P.F.I. revs.) | Freeness (C.s.f.) | Drainage time (secs.) | Tear Index | Breaking Length (km) | Burst Index |
| T | 1000 | 138 | 21.2 | 5.5 | 6.4 | 3.8 |

The freeness of 138 C.S.F. and drainage time of 21.2 secs after 1000 rev. beating in the P.F.I. mill (3.33 N/mm loading) represents a pulp which can find ready application in a number of blendstocks, including newsprint.

When undepithed bagasse is pulped by conventional means such as kraft of soda pulping, drainage times of several minutes are common because of the blockage effects exerted by the collapsed parenchyma cells in the final pulp product. This is unacceptable for papermaking applications and considerable efforts are usually expended to remove the parenchyma cells before feeding the bagasse to the digesters. The method of the present invention does not require prior removal of the parenchyma cells and represents a significant advantage in the treatment of high parenchyma cell content material.

EXAMPLE 8

A characteristic of some dense timbers, particularly hardwoods, is that upon air drying certain portions of the timber become virtually moisture impermeable upon rewetting. These moisture impermeable portions have the physical form of long splinters and represent a furnish of high stiffness and high moisture resistance for the subsequent manufacture of building boards.

The method of the present invention may be used to produce a mixture of such splinters together with papermaking pulp when the method is applied to dense hardwood chips which have been previously air dried. The product from the digester may then be separated by known screening techniques to give a pulp product fraction suitable for papermaking and a fraction primarily composed of impermeable splinters suitable for boardmaking.

The general method of the invention is to apply a relatively mild pulping treatment to the dense, air-dried woodchips. During this mild pulping treatment, the accessible portions of the woodchips become softened whilst the impermeable portions remain relatively unaffected. Upon discharging the mildly pulped woodchips the softened portions of the woodchips readily defibrate to give a pulp of papermaking quality whilst the impermeable portions of the woodchips pass through the nozzle relatively undamaged.

Cook U in Table 8 refers to *Eucalyptus hemiphloia* chips treated by the method of the invention. *Eucalyptus hemiphloia* is a dense hardwood species indigenous to the southern forests of Eastern Australia.

879 (g O.D. basis) of air dried *Eucalyptus hemipholoia* chips were impregnated, under vacuum, with 4 l of 50 g/l sodium sulphite solution. After impregnation, the remaining woodchips together with the remaining free liquor were charged to the digester and heated in 5.25 min by steam injection to 162° C. The digester was then further pressurized to 13.8 MPa with nitrogen. After maintaining the temperature at 162° C. for 10 min, the chips were discharged through an 8 bar nozzle.

TABLE 8

| Treatment of air-dried *Eucalyptus hemipholoia* woodchips | | |
|---|---|---|
| Cook No. | Yield (%) | Defibration (%) |
| U | 74.2 | 58.5 |

When screened over a 0.25 mm slotted screen, 58.5% of the product passed through the screen and 41.5% of the product remained as screen oversize.

The portion passing through the screen represented the pulp fraction suitable for papermaking and the 41.5% of the product remaining as screen oversize represented the impermeable wood portion suitable for building board manufacture.

Those skilled in the art will appreciate that the invention described herein is susceptible to variations and modifications other than those specifically described. It is to be understood that the invention includes all such variations and modifications which fall within its spirit and scope.

We claim:

1. In a process for explosively defibrating cellulosic fibre from plant material wherein the plant material is subjected to a high pressure environment followed by rapid transfer to a lower pressure environment, the improvement comprising passing the material from the high to the low pressure environment by way of a discharge nozzle across which a plurality of bars spanning diametrically across the nozzle having rounded leading edges facing in the direction of flow are arranged in such a manner as to cause the plant material passing therethrough to be folded over, successive bars thereby subjecting the folded plant material to shear and tensile forces generated by the concomitant passage of highly turbulent fluids causing the material to be successively pulled apart into individual fibres and fibre bundles wherein said bars are disposed at varying angles relative to each other along the longitudinal axis of the nozzle and the minimum number of bars and their arrangement in the nozzle is such that when the nozzle is viewed in the direction of passage of the plant material no clear passage exists in the nozzle through which a fragment of the plant material may traverse without being folded over a bar.

2. A discharge nozzle having a passageway through which cellulosic material may be explosively defibrated from a high pressure pulping digester to a lower pressure reservoir, said nozzle having a plurality of bars spanning diametrically across the nozzle having rounded leading edges facing the direction of flow extending across said passageway at varying locations along the longitudinal axis thereof so as to provide a series of the bars which are arranged so that any passing plant material is successively folded over the bars and pulled apart into individual fibres and small fibre bundles wherein the angles at which the axis of the bars are set relative to each other are randomized and the minimum number of bars and their arrangement in said passageway is such that when the passageway is viewed in the direction of passage of the plant material no clear passage exists in the passageway through which a fragment of the plant material may traverse without being folded over bar.

3. A discharge nozzle as set forth in claim 2, wherein the cross section of each bar is circular.

4. A discharge nozzle as set forth in claim 3, wherein each bar has a diameter greater than 2 mm and no more than 13 mm.

5. A discharge nozzle as claimed in any one of claims 2, 3 or 4 wherein when the cellulosic material has an average length "x," the spacing between the successive bars is at least x/2.

* * * * *